US008461812B2

(12) United States Patent
Kim et al.

(10) Patent No.: US 8,461,812 B2
(45) Date of Patent: Jun. 11, 2013

(54) SHUNT REGULATOR HAVING OVER-VOLTAGE PROTECTION CIRCUIT AND SEMICONDUCTOR DEVICE INCLUDING THE SAME

(75) Inventors: Han-Su Kim, Seoul (KR); Joo-Hyun Jeong, Yongin-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 897 days.

(21) Appl. No.: 12/327,458

(22) Filed: Dec. 3, 2008

(65) Prior Publication Data

US 2009/0146624 A1 Jun. 11, 2009

(30) Foreign Application Priority Data

Dec. 11, 2007 (KR) ..... 10-2007-0128313

(51) Int. Cl.
*G05F 1/613* (2006.01)

(52) U.S. Cl.
USPC ..... 323/225; 323/226; 323/276

(58) Field of Classification Search
USPC ..... 323/220, 223, 225, 226, 277, 276
See application file for complete search history.

(56) References Cited

U.S. PATENT DOCUMENTS 5,627,460 A * 5/1997 Bazinet et al. ..... 323/288
6,946,821 B2 * 9/2005 Hamon et al. ..... 323/273
7,586,716 B2 * 9/2009 Yamazaki ..... 361/18
2003/0112568 A1 * 6/2003 Holt et al. ..... 361/91.1
2006/0279262 A1 * 12/2006 Chiang et al. ..... 323/220
2008/0007231 A1 * 1/2008 Maige et al. ..... 323/225
2008/0074909 A1 * 3/2008 Mehta ..... 363/52
2009/0196079 A1 * 8/2009 Nathan ..... 363/50

FOREIGN PATENT DOCUMENTS

JP 2003-044151 2/2003
JP 2004-021577 1/2004
JP 2005-168229 6/2005

OTHER PUBLICATIONS

TL431 Adjustable Precision Shunt Regulators Datasheet, Texas Instruments, p. 9. 2004-2011. Obtained from http://www.ti.com/lit/ds/symlink/tl431.pdf on Sep. 1, 2011.*

Whitaker, J.C. (2006). "Microelectronics" (2nd ed.). Ch. 7, pp. 6-7. Boca Raton, FL: CRC Press.*

* cited by examiner

*Primary Examiner* — Adolf Berhane
*Assistant Examiner* — Fred E Finch, III
(74) *Attorney, Agent, or Firm* — F. Chau & Associates, LLC

(57) ABSTRACT

A shunt regulator includes a control circuit, a bypass circuit and a protection circuit. The control circuit is coupled between a first node and a ground, and generates a gate control signal in response to a voltage of the first node and a reference voltage. The bypass circuit forms a first current path between the first node and the ground in response to the gate control signal. The protection circuit has an MOS transistor that is fully turned on in response to a current flowing through the bypass circuit, and forms a second current path between the first node and the ground. Therefore, the shunt regulator occupies a relatively small area in an integrated circuit.

12 Claims, 7 Drawing Sheets

SHUNT REGULATOR HAVING OVER-VOLTAGE PROTECTION CIRCUIT AND SEMICONDUCTOR DEVICE INCLUDING THE SAME

CROSS-REFERENCE TO RELATED APPLICATION

This U.S. non-provisional patent application claims priority under 35 U.S.C. §119 of Korean Patent Application No. 2007-128313, filed on Dec. 11, 2007, the entire contents of which are hereby incorporated by reference.

BACKGROUND

1. Technical Field

This disclosure relates to a regulator and, more particularly, to a shunt regulator having an over-voltage protection function and a semiconductor device including the shunt regulator.

2. Discussion of Related Art

A regulator is a circuit block that supplies an output voltage having a substantially constant magnitude, even though the magnitude of an input voltage changes. A shunt regulator is a regulator that includes a current shunt to maintain a constant output voltage.

A conventional shunt regulator is shown in FIG. 1 and typically includes an operational amplifier 11 and a PMOS transistor MP1 and supplies a constant supply voltage VDD to a load 13.

The shunt regulator receives a DC input voltage VIN through a resistor R1 and generates a stabilized supply voltage VDD. The operational amplifier 11 receives a reference voltage VREF1 and a voltage from a feedback circuit formed of resistors R2 and R3 and generates an output voltage that changes in response to the fed-back supply voltage VDD. The output voltage of the operational amplifier 11 is stabilized by a capacitor C1 connected to ground GND. The PMOS transistor MP1 forms a current shunt between the supply voltage VDD and the ground voltage GND. The current flowing through the PMOS transistor MP1 increases when the supply voltage VDD increases, and the current flowing through the PMOS transistor MP1 decreases when the supply voltage VDD decreases. Therefore, the supply voltage VDD to the load 13 may be maintained at a substantially constant value.

When the DC input voltage VIN that is inputted to the shunt regulator excessively increases, a large current has to flow through the PMOS transistor MP1. Assuming that the threshold voltage of the PMOS transistor MP1 is VTH, and the gate-source voltage of the PMOS transistor MP1 is VGS, the overdrive voltage of the PMOS transistor MP1 may be expressed as VGS-VTH. VGS-VTH may be a relatively small value, however, because the output voltage of the operational amplifier 11 has a level of about VDD/2. Therefore, the size of the PMOS transistor MP1 must be sufficiently large, so that the large current may flow through the PMOS transistor MP1 without damaging it. That is, the ratio width/length of the gate of the PMOS transistor MP1 should be increased. For example, the gate width of the PMOS transistor may be in the thousands of μm. An MOS transistor having a gate width in the size of thousands of μm occupies a relatively large chip area in a semiconductor integrated circuit. Moreover, if the size of the MOS transistor is too large, the impedance of the MOS transistor is too low to be adapted for use in a radio frequency circuit.

SUMMARY

Accordingly, exemplary embodiments of the present invention are provided to substantially obviate one or more problems due to limitations and disadvantages of the related art described above.

Exemplary embodiments of the present invention provide a shunt regulator that occupies a small area in an integrated circuit and provides a current shunt when an over-voltage is applied through an input terminal.

Exemplary embodiments of the present invention also provide a semiconductor device having the shunt regulator.

In exemplary embodiments of the present invention, a shunt regulator includes a control circuit, a bypass circuit, and a protection circuit.

The control circuit is coupled between a first node and a ground, and generates a gate control signal in response to a voltage of the first node and a reference voltage. The bypass circuit forms a first current path between the first node and the ground in response to the gate control signal. The protection circuit has an MOS transistor that is fully turned on in response to a current flowing through the bypass circuit, and forms a second current path between the first node and the ground.

In exemplary embodiments, the MOS transistor may be driven by an output voltage of an inverter that operates in response to a voltage signal corresponding to a current flowing through the bypass circuit.

In exemplary embodiments, the protection circuit may include an inverter and a PMOS transistor. The inverter inverts a first voltage signal corresponding to a current flowing through the bypass circuit to generate a second voltage signal. The PMOS transistor operates in response to the second voltage signal.

In exemplary embodiments, the second voltage signal may have substantially the same magnitude as the ground voltage when the first voltage signal has a logic "high" state.

In exemplary embodiments, the protection circuit may include a first inverter, a second inverter and an NMOS transistor.

The first inverter inverts a first voltage signal corresponding to a current flowing through the bypass circuit to generate a second voltage signal. The second inverter inverts the second voltage signal to generate a third voltage signal. The NMOS transistor operates in response to the third voltage signal.

In exemplary embodiments, the third voltage signal may have substantially the same magnitude as a supply voltage when the first voltage signal has a logic "high" state.

In exemplary embodiments, the control circuit may include a feedback circuit and an operational amplifier.

The feedback circuit divides a voltage of a first node to generate a feedback voltage. The operational amplifier amplifies a difference between the feedback voltage and the reference voltage to generate a gate control signal.

In exemplary embodiments, the bypass circuit may include a PMOS transistor and a resistor.

The PMOS transistor has a source coupled to the first node and a drain coupled to a second node and operates in response to the gate control signal. The resistor is coupled between the second node and the ground.

In exemplary embodiments, the protection circuit operates in response to a voltage of the second node.

In embodiments, the bypass circuit may include an NMOS transistor and a resistor.

The NMOS transistor has a drain coupled to the first node and a source coupled to the second node and operates in response to the gate control signal. The resistor is coupled between the second node and the ground.

In exemplary embodiments, the shunt regulator may further include a resistor coupled between the first node and an input node to which an unstable DC input voltage is applied.

According to exemplary embodiments, the shunt regulator may further include a reference voltage generating circuit for generating a reference voltage.

In exemplary embodiments of the present invention, a semiconductor device includes a control circuit, a bypass circuit, a protection circuit and a load.

The control circuit is coupled between a first node and a ground, and generates a gate control signal in response to a voltage of the first node and a reference voltage. The bypass circuit forms a first current path between the first node and the ground in response to the gate control signal. The protection circuit has an MOS transistor that is fully turned on in response to a current flowing through the bypass circuit, and forms a second current path between the first node and the ground. The load operates in response to a voltage of the first node.

Therefore, the shunt regulator according to exemplary embodiments may occupy a small area in the integrated circuit and may be efficiently adapted for use in a radio frequency circuit, because an MOS transistor forming a current shunt may be designed to have a small size. In addition, the shunt regulator may form a current shunt to protect circuit elements in the semiconductor integrated circuit when an over-voltage is applied to the input terminals thereof.

BRIEF DESCRIPTION OF THE DRAWINGS

Exemplary embodiments of the present invention will be understood in more detail from the following descriptions taken in conjunction with the attached drawings.

DETAILED DESCRIPTION OF EXEMPLARY EMBODIMENTS

Figure 1:
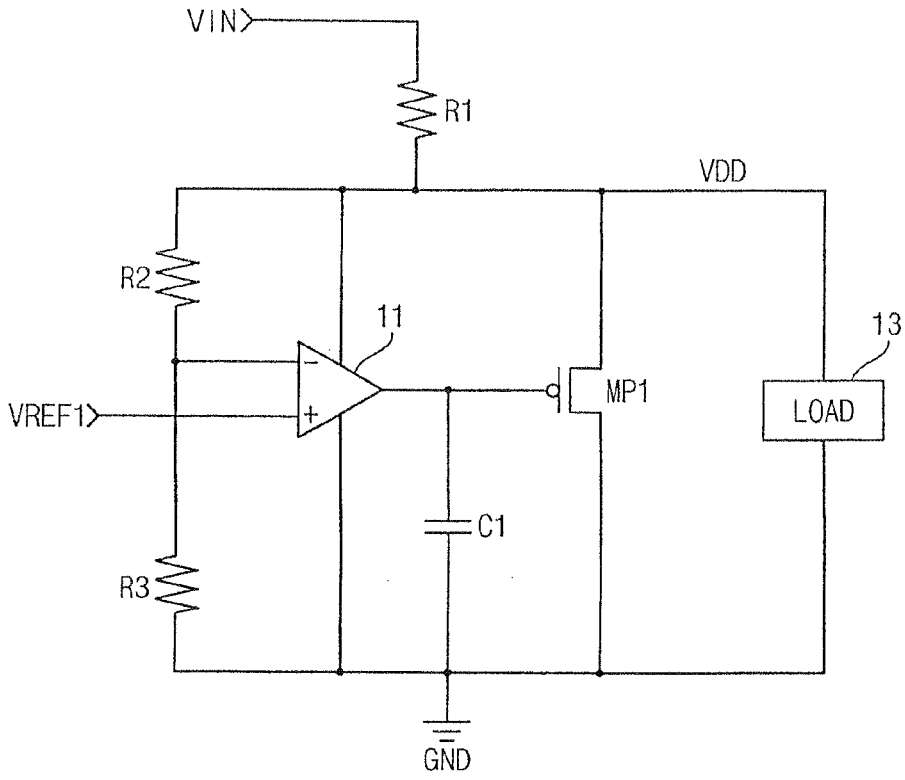
FIG.1 PRIOR ART
FIG. 1 is a block diagram illustrating a known shunt regulator according to conventional art.

Exemplary embodiments of the present invention now will be described more fully with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure will be thorough and complete, and will fully convey the scope of the invention to those of ordinary skill in the art. Like reference numerals refer to like elements throughout this application.

Figure 2:
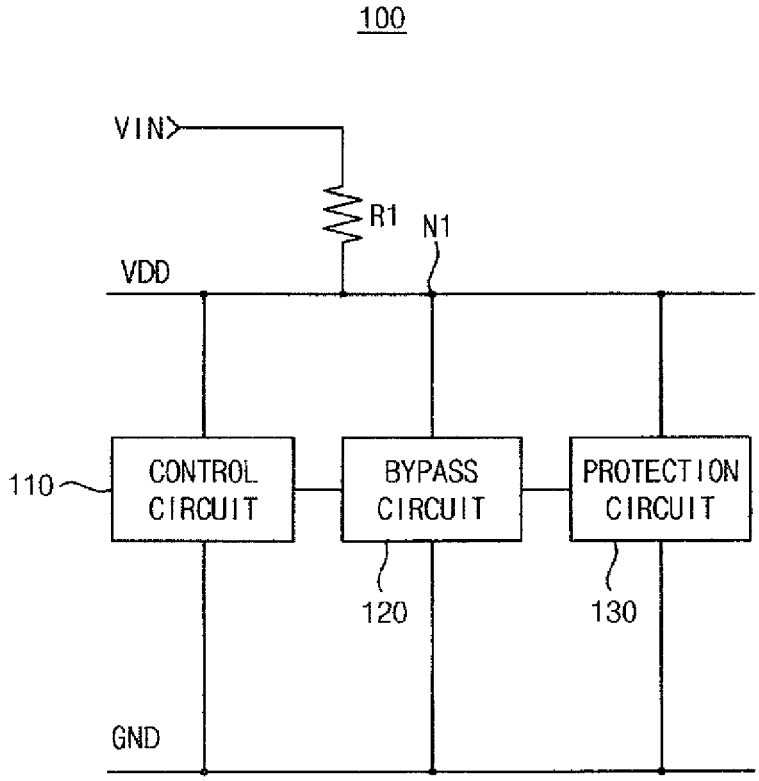
FIG. 2 is a circuit diagram illustrating a shunt regulator according to an exemplary embodiment of the present invention.

FIG. 2 is a block diagram illustrating a shunt regulator according to an exemplary embodiment of the present invention.

Referring to FIG. 2, the shunt regulator 100 includes a control circuit 110, a bypass circuit 120 and a protection circuit 130, which are coupled between a voltage VDD obtained from an input voltage VIN and a resistor R1 and a ground GND. Exemplary configurations of the shunt regulator 100 will be described in more detail with reference to circuit diagrams of FIGS. 3 and 10.

Figure 3:
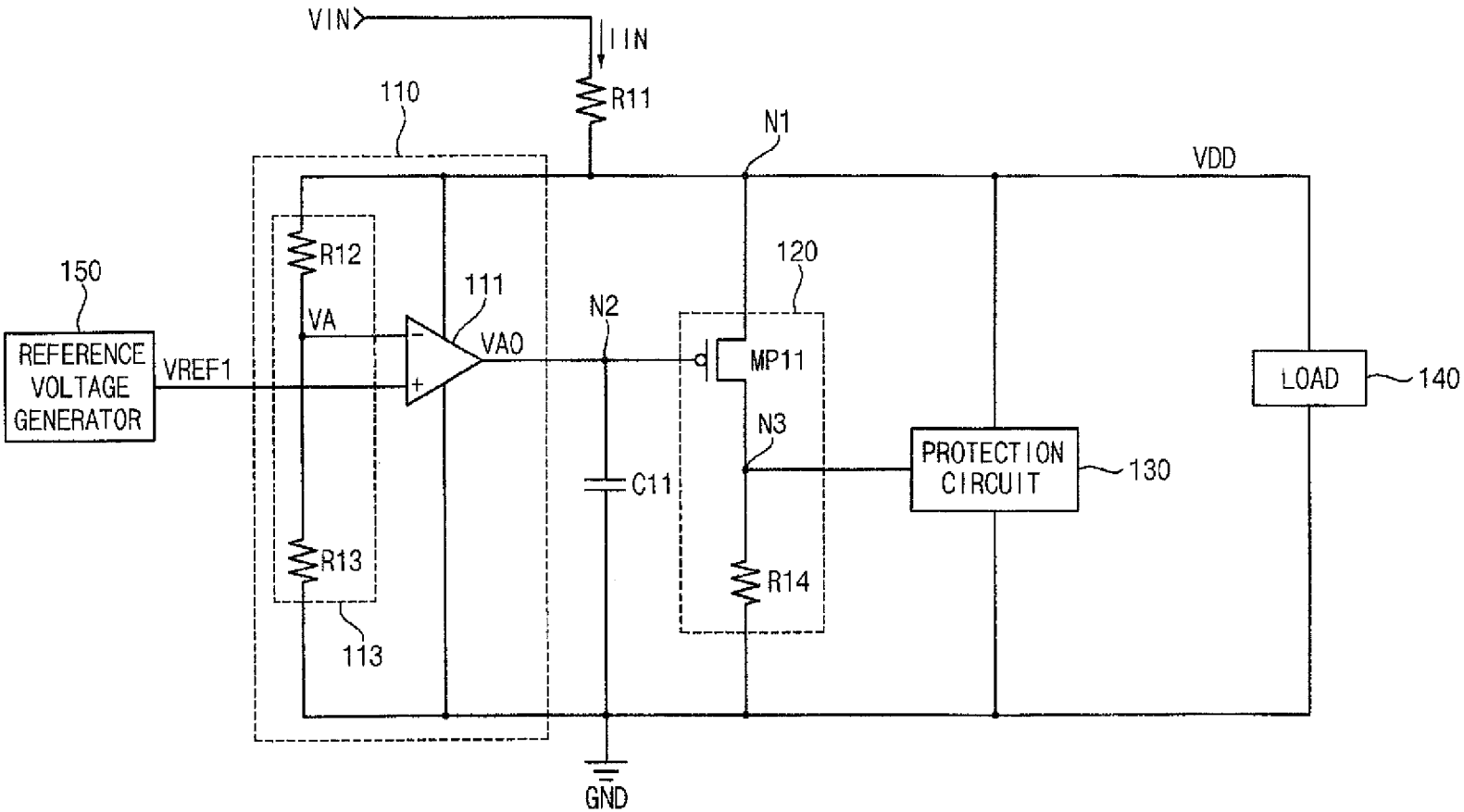
FIG. 3 is a circuit diagram showing the shunt regulator of FIG. 2 in more detail.

FIG. 3 is a circuit diagram illustrating a shunt regulator 100 according to an exemplary embodiment of the present invention.

Referring to FIG. 3, the shunt regulator 100 includes the control circuit 110, the bypass circuit 120 and the protection circuit 130.

The control circuit 110 is coupled between a first node N1 and a ground GND, and generates a gate control signal VAO in response to a voltage VDD of the first node N1 and a reference voltage VREF1. The gate control signal VAO is outputted to a second node N2. The bypass circuit 120 receives the gate control signal VAO from the second node N2 and forms a first current path between the first node N1 and the ground GND in response to the gate control signal VAO. The protection circuit 130 has an MOS transistor that is fully turned on in response to a current flowing through the bypass circuit 120, and forms a second current path between the first node N1 and the ground GND.

In addition, the shunt regulator 100 includes a first resistor R11 coupled between an input node to which an unstable DC input voltage VIN is applied and the first node N1. The shunt regulator 100 supplies a stable supply voltage VDD to a load 140. The load 140 may be a functional circuit block that is in a semiconductor device. The load 140 may receive the voltage VDD as an internal power supply voltage. In addition, the shunt regulator 100 may include a reference voltage generating circuit 150 for generating the reference voltage VREF1.

Referring to FIG. 3, the control circuit 110 includes a feedback circuit 113 and an operational amplifier 111.

The feedback circuit 113 divides a voltage of the first node N1 to generate a feedback voltage VA. The operational amplifier 111 amplifies a difference between the feedback voltage VA and the reference voltage VREF1 to generate the gate control signal VAO. An output terminal of the operational amplifier 111 is coupled to the second node N2.

The feedback circuit 113 may include a second resistor R12 and a third resistor R13.

The second resistor R12 is coupled between the first node N1 and an inverted input terminal of the operational amplifier 111, and the third resistor R13 is coupled between the inverted input terminal of the operational amplifier 111 and the ground GND.

The bypass circuit 120 may include a first PMOS transistor MP11 and a fourth resistor R14. The first PMOS transistor MP11 has a source coupled to the first node N1, a gate coupled to the second node N2, and a drain coupled to a third node N3 and operates in response to the gate control signal VAO. The fourth resistor R14 is coupled between the third node N3 and the ground GND. The protection circuit 130 operates in response to a voltage of the third node N3.

Further, the shunt regulator 100 may include a capacitor C11 having one terminal connected to ground to stabilize a voltage of the second node N2 to which a gate of the first PMOS transistor MP11 is coupled.

Figure 4:
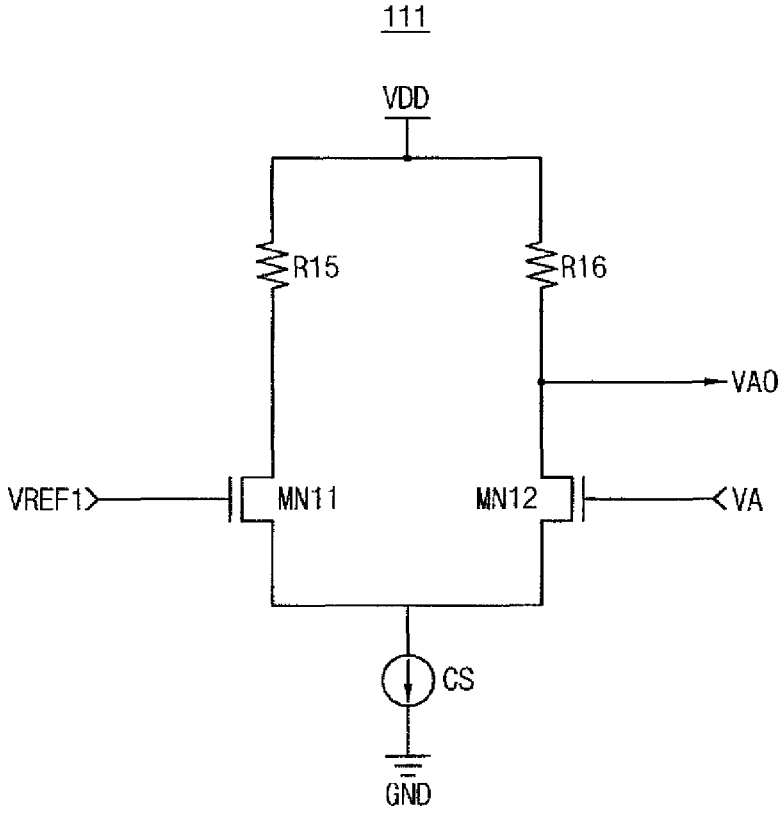
FIG. 4 is a circuit diagram illustrating an exemplary embodiment of an operational amplifier included in the shunt regulator of FIG. 3.

FIG. 4 is a circuit diagram illustrating an exemplary embodiment of an operational amplifier 111 included in the shunt regulator 100 of FIG. 3.

Referring to FIG. 4, the operational amplifier 111 includes a first NMOS transistor MN11, a second NMOS transistor MN12, a fifth resistor R15, a sixth resistor R16, and a current source CS.

The gate control signal VAO is an amplified signal of a difference between the feedback voltage VA and the reference voltage VREF1. The magnitude of the gate control signal VAO increases when the feedback voltage VA is smaller than the reference voltage VREF1, and the magnitude of VAO decreases when the feedback voltage VA is greater than the reference voltage VREF1. The gate control signal VAO may increase or decrease according to a deviation of the feedback voltage VA with respect to a reference voltage, for example, VDD/2.

Figure 5:
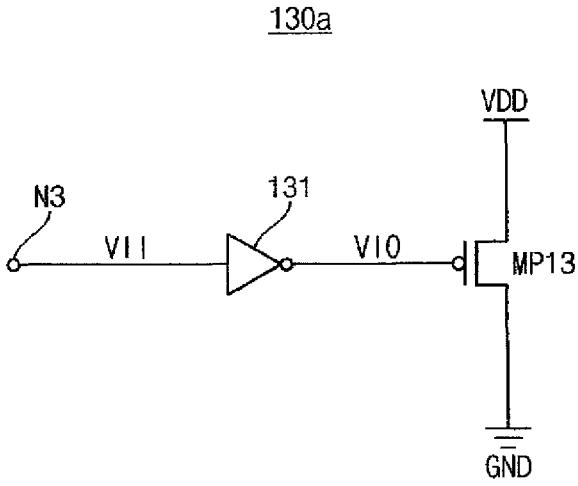
FIG. 5 is a circuit diagram illustrating an exemplary embodiment of a protection circuit included in the shunt regulator of FIG. 3.

FIG. 5 is a circuit diagram illustrating an exemplary embodiment of the protection circuit 130 included in the shunt regulator 100 of FIG. 3.

Referring to FIG. 5, the protection circuit 130*a* includes a first inverter 131 and a second PMOS transistor MP13.

The first inverter 131 is coupled between the third node N3 and the second PMOS transistor MP13, and inverts a voltage VII of the third node N3 to generate a first gate control signal VIO. The second PMOS transistor MP13 forms a current path between the supply voltage VDD and the ground GND in response to the first gate control signal VIO.

Figure 6:
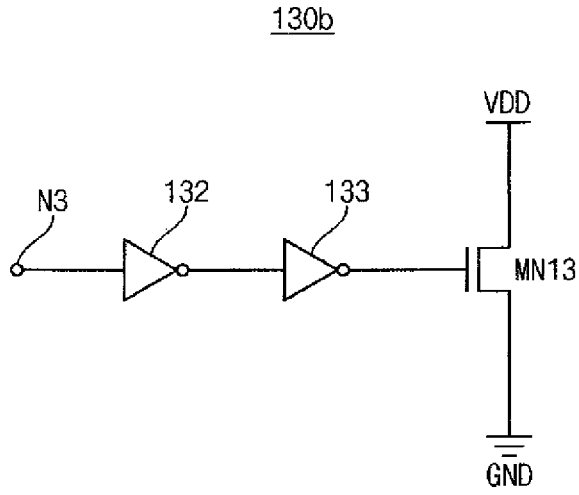
FIG. 6 is a circuit diagram illustrating an exemplary embodiment of a protection circuit included in the shunt regulator of FIG. 3.

FIG. 6 is a circuit diagram illustrating an exemplary embodiment of the protection circuit 130 included in the shunt regulator of FIG. 3.

Referring to FIG. 6, a protection circuit 130*b* includes a second inverter 132, a third inverter 133, and a third NMOS transistor MN13.

The second inverter 132 inverts a voltage of the third node N3 and the third inverter 133 inverts an output signal of the second inverter 132. The third NMOS transistor MN13 forms a current path between the supply voltage VDD and the ground GND in response to an output voltage signal of the third inverter 133.

Figure 7:
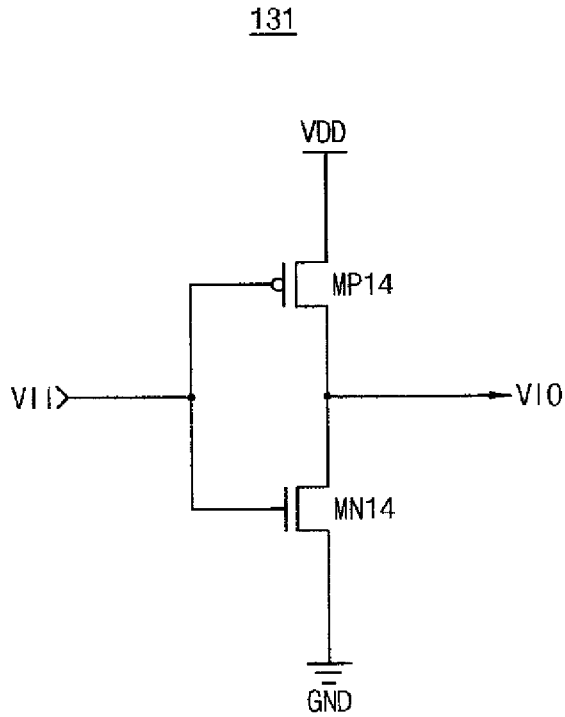
FIG. 7 is a circuit diagram illustrating a structure of a CMOS inverter including a PMOS transistor and an NMOS transistor.

FIG. 7 is a circuit diagram illustrating a structure of a CMOS inverter 131 of FIG. 5 including a PMOS transistor and an NMOS transistor.

Referring to FIG. 7, the CMOS inverter 131 includes a third PMOS transistor MP14 and a fourth NMOS transistor MN14.

A gate of the third PMOS transistor MP14 and a gate of the fourth NMOS transistor MN14 are electrically coupled to each other, and the CMOS inverter 131 operates in response to the voltage VII of the third node N3. A drain of the third PMOS transistor MP14 and a drain of the fourth NMOS transistor MN14 are electrically coupled to each other, and the first gate control signal VIO is outputted at a connection point at the gate of the second PMOS transistor MP13.

Figure 8:
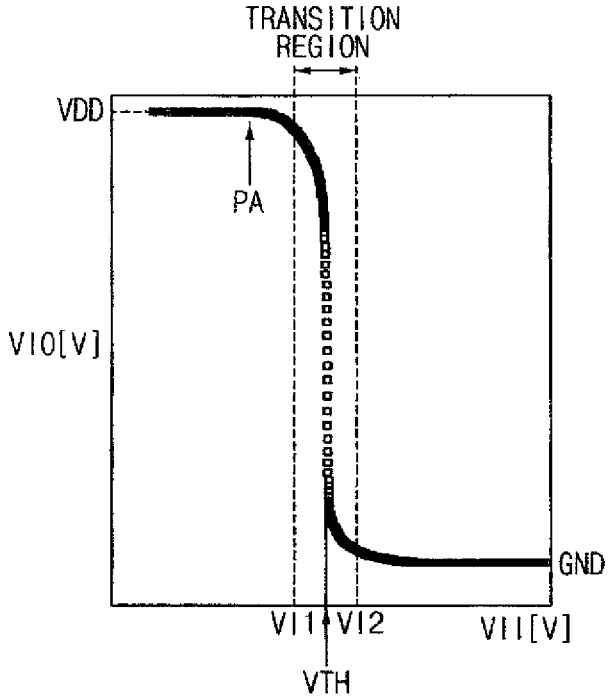
FIG. 8 is a diagram of a voltage-sweeping curve representing a relationship between an input voltage and an output voltage of a CMOS inverter shown in FIG. 7.

FIG. 8 is a diagram of a voltage-sweeping curve representing the relationship between an input voltage VII and an output voltage VIO of the CMOS inverter 131 shown in FIG. 7.

Referring to FIG. 8, the operation region of the CMOS inverter 131 has a first region in which the CMOS inverter 131 maintains the supply voltage VDD at a constant level, a second region including a transition region, and a third region in which the CMOS inverter 131 maintains the voltage at the ground voltage GND level.

When the input voltage VII of the CMOS inverter 131 shown in FIG. 7 is a logic "low" state, the output voltage VIO maintains the supply voltage VDD, and when the input voltage VII of the CMOS inverter 131 is a logic "high" state, the output voltage VIO maintains the ground voltage GND. When the input voltage VII of the CMOS inverter 131 increases from 0V, the output voltage VIO maintains the supply voltage VDD. Then, the output voltage VIO starts to decrease at a point PA, and decreases abruptly to the ground voltage GND when the input voltage VII approaches a threshold voltage VTH.

The transition region is a region between VI1 and VI2, which is narrow compared with the first region or the second region. Therefore, the CMOS inverter 131 may operate as a switch, and may be used to perform buffering at an input/output stage of an electronic circuit.

Figure 9:
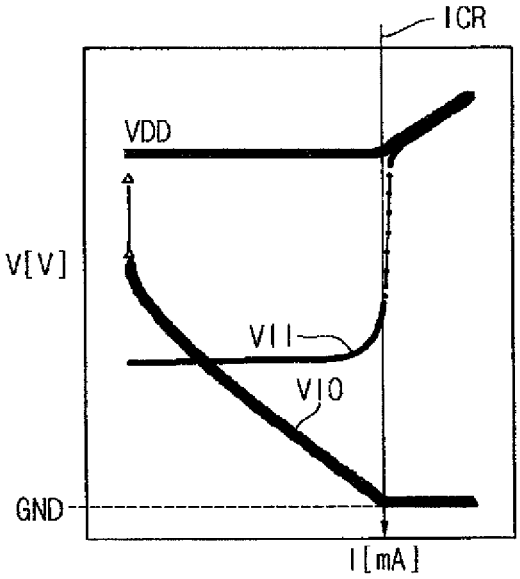
FIG. 9 is a diagram illustrating an input voltage and an output voltage of a CMOS inverter in FIG. 7 when a current applied to the shunt regulator shown in FIG. 3 changes.

FIG. 9 is a diagram illustrating an input voltage VII and an output voltage VIO of the CMOS inverter 131 in FIG. 7 when a current IIN applied to the shunt regulator 100 shown in FIG. 3 changes.

In FIG. 9, ICR denotes a magnitude of the input current IIN that is inputted to the shunt regulator 100 when the output voltage VIO completely becomes 0V in response to the input voltage VII of the CMOS inverter 131. Additionally, "I" shown in FIG. 9 denotes current IIN in the shunt regulator 100 shown in FIG. 3.

Hereinafter, the operation of the shunt regulator 100 according to an exemplary embodiment will be described, referring to FIGS. 3 through 9.

The shunt regulator 100 stabilizes the DC input voltage VIN to generate the supply voltage VDD, and supplies the supply voltage VDD to the load 140. When the DC input voltage changes, the input current IIN flowing through the first resistor R11 changes according to the change of the input voltage. The supply voltage VDD, which is a voltage of the first node N1, becomes stable by the operation of the control circuit 110, the bypass circuit 120, and the protection circuit 130, and may have a substantially constant value.

In a normal operation mode, the shunt regulator 100 operates as follows.

The shunt regulator 100 senses the voltage of the first node N1 to generate the feedback voltage VA using the feedback circuit 113. The feedback voltage VA is compared with the reference voltage VREF1 by the operational amplifier 111. The gate control signal VAO, which is an output signal of the operational amplifier 111, is applied to a gate of the first PMOS transistor MP11.

When the magnitude of the voltage of the first node N1 increases, the magnitude of the feedback voltage VA increases accordingly, but the gate control signal VAO decreases. Therefore, the magnitude of a current flowing through the bypass circuit 120 increases and the magnitude of the voltage of the first node N1 decreases.

When the magnitude of the voltage of the first node N1 decreases, the magnitude of the feedback voltage VA decreases accordingly, but the gate control signal VAO increases. Therefore, the magnitude of a current flowing through the bypass circuit 120 decreases and the magnitude of the voltage of the first node N1 increases.

Therefore, the supply voltage VDD, which is a voltage of the first node N1, maintains a substantially constant value.

In an over-voltage operation mode, the shunt regulator 100 operates as follows.

When an over-voltage is applied to the shunt regulator 100, the input current IIN flowing through the first resistor R11 corresponds to an over-current. The shunt regulator 100 senses the voltage of the first node N1 to generate the feedback voltage VA using the feedback circuit 113. The feedback voltage VA is compared with the reference voltage VREF1 by the operational amplifier 111. The gate control signal VAO, which is an output signal of the operational amplifier 111 is applied to a gate of the first PMOS transistor MP11.

When the magnitude of the voltage of the first node N1 increases excessively, an over-current may flow through a gate of the first PMOS transistor MP11 and the fourth resistor R14. When a current flowing through the fourth resistor R14 reaches a first voltage, the protection circuit 130 becomes activated.

Referring to FIG. 5, when the input voltage VII, which is the voltage signal of the third node N3, reaches the first voltage, the CMOS inverter 131 is turned on and the output voltage VIO is generated. The first voltage is the threshold voltage (VTH in FIG. 8) for turning on the CMOS inverter 131. The CMOS inverter 131 inverts the input voltage VII when the input voltage VII that is larger than the threshold voltage VTH is applied to the CMOS inverter 131.

For example, when the input voltage VII increases and reaches the threshold voltage VTH, the output voltage VIO of the CMOS inverter 131 transitions from the supply voltage VDD level to the ground GND level. At this time, the second PMOS transistor MP13 becomes fully turned on and a relatively large current may flow through the second PMOS transistor MP13, because the ground voltage GND is applied to the gate of the second PMOS transistor MP13.

That is, when the over-voltage is applied to the shunt regulator 100, the protection circuit 130 forms a shunt between the supply voltage VDD and the ground voltage GND and maintains the supply voltage VDD at a constant value.

Accordingly, the shunt regulator 100 according to the exemplary embodiment shown in FIG. 3 forms a shunt through the protection circuit 130 and maintains the supply voltage VDD at a constant value when the over-voltage is applied to the shunt regulator 100, because the shunt regulator 100 includes the protection circuit 130 as well as the bypass circuit 120.

If the protection circuit 130 is excluded, when the over-voltage is applied to the shunt regulator 100, the bypass circuit 120 including the first PMOS transistor MP11 may form a shunt to stabilize the supply voltage VDD, which is the voltage of the first node N1.

A voltage of the gate of the first PMOS transistor MP11 in the bypass circuit 120, which is a voltage of the second node N2, however, increases or decreases from a predetermined voltage, for example, VDD/2. Therefore, there is a limit to the increase in the amount of current that can flow through the first PMOS transistor MP11.

Accordingly, there is a limit to the possible stabilization of the supply voltage VDD using only the bypass circuit 120 when the over-voltage is applied to the shunt regulator 100.

Furthermore, in the shunt regulator 100 according to the exemplary embodiment shown in FIG. 3, the gate width of the first PMOS transistor MP11 may have a relatively small value, for example, tens of μm. The gate width of the second PMOS transistor (MP13 in FIG. 5) may be on the order of hundreds of μm. In the conventional shunt regulator, the gate width of the PMOS transistor MP1 for a shunt should be in the thousands of μm.

The shunt regulator 100 shown in FIG. 3 forms a current path by including the protection circuit 130 that is activated when the over-voltage is applied. Therefore, the first PMOS transistor MP11 in the bypass circuit 120 occupies a much smaller area than the PMOS transistor MP1 in the conventional shunt regulator. The size of the second PMOS transistor MP13 in the protection circuit 130 may be smaller than the size of the PMOS transistor MP1 in the conventional shunt regulator.

Figure 10:
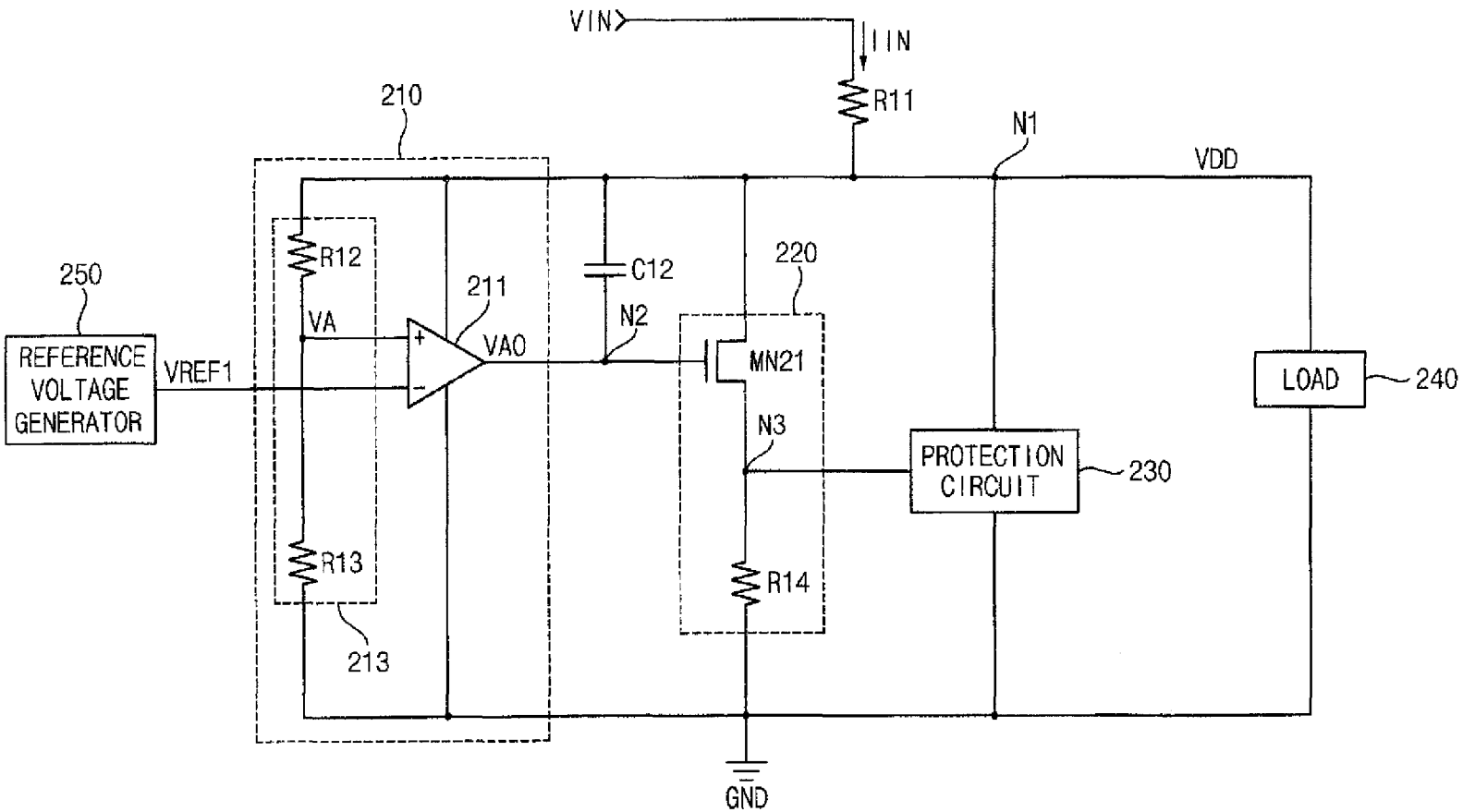
FIG. 10 is a circuit diagram illustrating a shunt regulator according to an exemplary embodiment of the present invention.

FIG. 10 is a circuit diagram illustrating a shunt regulator 200 according to an exemplary embodiment of the present invention.

The structure of a bypass circuit 220 in the shunt regulator 200 of FIG. 10 is different from the structure of the bypass circuit 110 in the shunt regulator 100 of FIG. 3. The remaining structure of the circuit except for the bypass circuit 220 is similar to the structure of the circuit shown in FIG. 3.

Referring to FIG. 10, the shunt regulator 200 includes a control circuit 210, a bypass circuit 220 and a protection circuit 230.

The control circuit 210 is coupled between a first node N1 and a ground GND, and generates a gate control signal VAO in response to a voltage VDD of the first node N1 and a reference voltage VREF1. The gate control signal VAO is outputted to a second node N2. The bypass circuit 220 receives the gate control signal VAO from the second node N2 and forms a first current path between the first node N1 and the ground GND in response to the gate control signal VAO. The protection circuit 230 has an MOS transistor that is fully turned on in response to a current flowing through the bypass circuit 220, and forms a second current path between the first node N1 and the ground GND.

Additionally, the shunt regulator 200 may include a first resistor R11 coupled between an input node to which an unstable DC input voltage VIN is applied and the first node N1. The shunt regulator 200 supplies a stable supply voltage VDD to a load 240. The load 240 may be, for example, a functional circuit block that is in a semiconductor device. Further, the shunt regulator 200 may include a reference voltage generating circuit 250 for generating the reference voltage VREF1.

Referring to FIG. 10, the control circuit 210 includes a feedback circuit 213 and an operational amplifier 211.

The feedback circuit 213 divides a voltage of the first node N1 to generate a feedback voltage VA. The operational amplifier 211 amplifies a difference between the feedback voltage VA and the reference voltage VREF1 to generate the gate control signal VAO. An output terminal of the operational amplifier 211 is coupled to the second node N2.

The feedback circuit 213 includes a second resistor R12 and a third resistor R13.

The bypass circuit 220 includes a fifth NMOS transistor MN21 and a fourth resistor R14. The fifth NMOS transistor MN21 has a drain coupled to the first node N1, a gate coupled to the second node N2, and a source coupled to a third node N3 and operates in response to the gate control signal VAO. A fourth resistor R14 is coupled between the third node N3 and the ground GND. The protection circuit 230 operates in response to a voltage of the third node N3.

The shunt regulator 200 may include a capacitor C12 connected between VDD and the second node N2 to stabilize a voltage of the second node N2 to which a gate of the fifth NMOS transistor MN21 is coupled.

The operation of the shunt regulator 200 shown in FIG. 10 is similar to the operation of the shunt regulator 100 shown in FIG. 3. Therefore, the operation of the shunt regulator 200 need not be further described.

While exemplary embodiments of the present invention and their advantages have been described in detail, it should be understood that various changes, substitutions and alterations can be made herein without departing from the scope of the invention, as defined by appended claims.

What is claimed is:

1. A shunt regulator comprising:

a control circuit coupled between a first node and a ground, and configured to generate a gate control signal in response to a voltage of the first node and a reference voltage;

a bypass circuit configured to form a first current path between the first node and the ground in response to the gate control signal; and a protection circuit having a PMOS transistor whose source is directly connected to the first node and whose drain is directly connected to the ground, the PMOS transistor being fully turned on in response to a current flowing through the bypass circuit, and configured to form a second current path between the first node and the ground, wherein the protection circuit comprises a CMOS inverter coupled between the first node and the ground for inverting a first voltage signal corresponding to the current flowing through the bypass circuit to generate a second voltage signal to turn on the PMOS transistor when the voltage of the first node increases above a desired voltage, and wherein the second voltage signal has substantially the same magnitude as the voltage of the first node when the first voltage signal has a logic "low" state.

2. The shunt regulator of claim 1, wherein the second voltage signal has substantially the same magnitude as a voltage of the ground when the first voltage signal has a logic "high" state.

3. The shunt regulator of claim 1, wherein the control circuit comprises:

a feedback circuit configured to divide a voltage of the first node to generate a feedback voltage; and an operational amplifier configured to amplify a difference between the feedback voltage and the reference voltage to generate the gate control signal.

4. The shunt regulator of claim 3, wherein the feedback circuit comprises:

a first resistor coupled between the first node and a first input terminal of the operational amplifier; and a second resistor coupled between the first input terminal of the operational amplifier and the ground.

5. The shunt regulator of claim 1, wherein the bypass circuit comprises:

a PMOS transistor that has a source coupled to the first node and a drain coupled to a second node and operates in response to the gate control signal; and a resistor coupled between the second node and the ground.

6. The shunt regulator of claim 5, wherein the protection circuit is configured to operate in response to a voltage of the second node.

7. The shunt regulator of claim 1, wherein the bypass circuit comprises:

an NMOS transistor that has a drain coupled to the first node and a source coupled to a second node and operates in response to the gate control signal; and a resistor coupled between the second node and the ground.

8. The shunt regulator of claim 1, further comprising: a resistor coupled between the first node and an input node to which an unstable DC input voltage is applied.

9. The shunt regulator of claim 1, further comprising: a reference voltage generating circuit for generating the reference voltage.

10. A semiconductor device comprising:

a control circuit coupled between a first node and a ground and configured to generate a gate control signal in response to a voltage of the first node and a reference voltage;

a bypass circuit configured to form a first current path between the first node and the ground in response to the gate control signal;

a protection circuit having a PMOS transistor whose source is directly connected to the first node and whose drain is directly connected to the ground, the PMOS transistor being fully turned on in response to a current flowing through the bypass circuit, and configured to form a second current path between the first node and the ground, and a load that operates in response to a voltage of the first node, wherein the protection circuit comprises a CMOS inverter coupled between the first node and the ground for inverting a first voltage signal corresponding to the current flowing through the bypass circuit to generate a second voltage signal to turn on the PMOS transistor when the voltage of the first node increases above a desired voltage, and wherein the second voltage signal has substantially the same magnitude as the voltage of the first node when the first voltage signal has a logic "low" state.

11. The semiconductor device of claim 10, wherein the second voltage signal has substantially the same magnitude as a voltage of the ground when the first voltage signal has a logic "high" state.

12. The semiconductor device of claim 10, further comprising: a resistor coupled between the first node and an input node to which an unstable DC input voltage is applied.

* * * * *